US007404398B2

(12) United States Patent
Henricks

(10) Patent No.: US 7,404,398 B2
(45) Date of Patent: Jul. 29, 2008

(54) SEMI-SOLID BIODEGRADABLE SLUG PROPULSION DEVICE

(75) Inventor: Matthew Joseph Henricks, 9632 Velardo Dr., Huntington Beach, CA (US) 92646

(73) Assignee: Matthew Joseph Henricks, Huntington Beach, CA (US)

( * ) Notice: Subject to any disclaimer, the term of this patent is extended or adjusted under 35 U.S.C. 154(b) by 0 days.

(21) Appl. No.: 11/044,355

(22) Filed: Jan. 28, 2005

(65) Prior Publication Data

US 2006/0169262 A1 Aug. 3, 2006

(51) Int. Cl.
*F41B 11/14* (2006.01)
*F41B 11/12* (2006.01)
*F41B 11/18* (2006.01)

(52) U.S. Cl. ..... 124/66; 124/64; 124/65

(58) Field of Classification Search ..... 124/63–67; 446/473

See application file for complete search history.

(56) References Cited

OTHER PUBLICATIONS http://www.wonderfullywacky.com/potato-gun.htm?AID=10273718&PID=1335703 1 Page.*
http://www.gizmoandwidget.com/acatalog/Gizmo_and_Widget_Really_Retro_3.html 2 Pages.*
http://www.mables.com/potato-gun.php 1 Page.*
http://www.otherlandtoys.co.uk/product_info.php?products_id=1343&products_id=1343 (1 Page).
http://www.baronbob.com/potato-gun.htm (2 Pages).
http://www.gizmoandwidget.com/index.php?main_page=product_info&products_id=68 (2 Pages).
http://www.mables.com/potato-gun.php (2 Pages).
http://cgi.ebay.com/ws/eBayISAPI.dll?ViewItem&item=6066580397&ssPageName=MERCOSI_VI_ROSI_PR4_PCN_BIX (6 pages).

* cited by examiner

*Primary Examiner*—Michael J. Carone
*Assistant Examiner*—Stewart T Knox

(57) ABSTRACT

A propulsion system consisting of a handle, trigger, receiver, hammer assembly, spring, fastener and plunger used for propelling small portions of semi-solid biodegradable objects such as a potato or apple. The combination of these parts provides a compact yet easy to use system for loading and shooting a small piece (otherwise known as the Slug) of the semi-solid biodegradable object. It also is a platform to generate, store and release in a controlled manor potential energy with the end result being to compress a separate, self resetting compression chamber filled with air and propel the small portions of the semi-solid biodegradable object from the device.

17 Claims, 8 Drawing Sheets

SEMI-SOLID BIODEGRADABLE SLUG PROPULSION DEVICE

BACKGROUND OF THE INVENTION

In the 1950's a toy was mass-produced that was designed to core and shoot a portion of a potato (a slug) or any other semi-solid biodegradable object. Primarily known as the "Spud Gun", this all-metal toy was very popular in its time with kids of all ages. Its basic principle was to core a small slug of the potato using the hollow round tip of the shooter. Then using a two-part plunger system it would compress ordinary air behind the slug and therefore propel the slug out of the gun in the direction aimed. This toy enjoyed wide popularity along with other shooting toys from that generation such as Rubber Band Guns, Sling Shots and BB Guns. In recent years, the "Spud Gun" has enjoyed a re-birth as the same basic toy only now manufactured in plastic and marketed as a "retro" toy in order to capture the memories of those who had them as kids and hopefully to be shared with a new generation of kids. This new generation of "Spud Gun" can easily be purchased at most novelty stores or through many Internet sites.

In general, the "Spud Gun" was effective in shooting the slug of the semi-solid biodegradable object. Unfortunately, the reality of the matter was that it did not perform very well because of a few inherent design flaws. There are three main flaws in the original design that needed to be addressed in order to make the "Spud Gun" a more effective shooter. The use of the Human hand to generate the necessary power to propel the slug is the first. This is followed by the inaccuracy of the shooter when trying to hit a target because the human hand is used to generate the needed energy to propel the slug and the method by which the shooter was loaded in order to seal enough air inside to propel the slug.

The primary source of power in the original design in order to compress the air pocket and propel the slug was the human hand. While the hand is a great source for power and readily available it is not a great tool when required to generate the needed energy to propel the slug with the design of the vintage "Spud Gun". You just could not get very much power to propel the slug very far. The "Spud Gun" used the human hand in a squeezing motion to generate the power. This motion is used to compress an air pocket that has been sealed behind the slug inside the compression chamber. When enough pressure was generated the slug would pop out of the tip of the toy and be propelled in the desired direction. Unfortunately, you can only get so much force out of the hand with this motion. This group of muscle in the hand is not as strong or fast as other potential sources of energy.

Since the original shooter was made from two primary parts and since these parts were designed to be squeezed together it was very easy to reduce the size of the compression chamber while trying loading the projectile. Loading was accomplished by jamming the hollow tip of the shooter into the semi-solid biodegradable object and breaking of the core that was cut and wedged into the hollow tip of the shooter. The motion of jamming the tip into the semi-solid biodegradable object frequently results in the compression chamber inside the unit being reduced in size as the two main pieces of the shooter were pressed together in order to penetrate the skin of the semi-solid biodegradable object. Once the chamber had been compressed and the hollow tip of the shooter sealed by the cored semi-solid biodegradable projectile the gun was even harder to use because you no longer had as much air in the compression chamber to compress and therefore propel the slug. Because of this the gun had to be unloaded and extra effort had to be made while loading the shooter in order to keep the two halves from compressing while the slug was loaded. This was especially difficult for younger users of the toy as well as it hindered the efficiency of the toy.

The Last flaw was again related to the use of the Human hand for propulsion. The inherent "jerking" motion required to squeeze the human hand in a fast strong motion did not allow the hand to maintain a steady position and therefore an accurate aim. This jerking motion generally moved the tip of the shooter and changes the trajectory in which the projectile was intended to go. In order to maintain a steady aim while shooting you had to somehow maintain a smooth squeezing motion when trying to generate the most power from you hand. That was the only way to maximize the distance at which the projectile was launched while maintaining some sort of accurate aim. This inherently reduced the power generating by the hand and once again reduced the efficiency of the shooter.

All of these factors were compounded when the person using the toy was a child, as children generally do not have large strong hands that allow the user to compensate for these design flaws. Generally speaking, the best that these shooters could propel the semi-solid biodegradable slug is not much more then 15 feet.

BRIEF SUMMARY OF THE INVENTION

Accordingly, the invention presented within is a propulsion device designed to overcome the shortcomings of similar vintage devices. The invention presented here includes an integral mechanism by which the user can easily load and fire a small piece of semi-solid biodegradable material. Marrying the following components together, Receiver, Hammer, Hammer Handle, Plunger, Trigger, Stock, Propulsion Spring, Trigger Return Spring, Mass Slug, Pivot Pin and Fastener System, the end result is an easy to use and very efficient device to fire a slug from a semi-solid biodegradable object.

One goal of the presented device is the method by which to easily load and fire the projectile with minimal effort. The device presented has an integral projectile retention system (the external hollow coring bore using friction to retain the projectile) along with a device to set and store the needed energy to fire the device (The Hammer, Hammer Handle, Plunger, Trigger, and Propulsion Spring) by simply pulling back on the trigger and releasing the energy by disengaging the latch on the Trigger holding back the Hammer. No longer does the user need to try and develop the needed energy to fire the device by squeezing their hand together. The combination of these parts, along with the Mass Slug, Pivot Pin and Fastener System housed inside the Receiver provides the needed components to do this.

The second goal of the presented device is the use of a compression chamber that is decoupled from the energy storage device inside the receiver. The device features an integral yet separate compression chamber that is sealed by the projectile on one end and plunger on the other and is set simply by loading the projectile. The user no longer needs to maintain the separation of the two-part handle in order to maintain a proper compression chamber.

The third goal of the presented device is the method by which the compression chamber is set. The device features a probe on the tip of the plunger that protrudes out the front of the device. When the probe comes in contact with the source for the semi-solid biodegradable slug (generally an apple or potato) it is pushed back inside the receiver as the tip of the device is forced into the semi-solid biodegradable and the slug is cored. The length of the probe sets the size of the compression chamber and therefore the amount of air that is trapped inside the chamber and available to compress.

The last goal of the presented device is to provide a stable platform and energy source to fire the projectile and maintain a high level of accuracy. This is accomplished through the unique energy storage device and the way that this energy is transferred to propel the projectile. The user no longer needs to worry about the stability of their hand while generating the needed energy to fire the device. Once loaded, simply pull the trigger and the device will release the stored energy and propel the slug from the tip of the device.

BRIEF DESCRIPTION OF THE DRAWINGS

A better understanding of the invention and many of its advantages will become better understood by referencing following detailed descriptions when considered along with the following drawings, wherein.

DETAILED DESCRIPTION OF THE PREFERRED EMBODIMENTS

Figure 1:
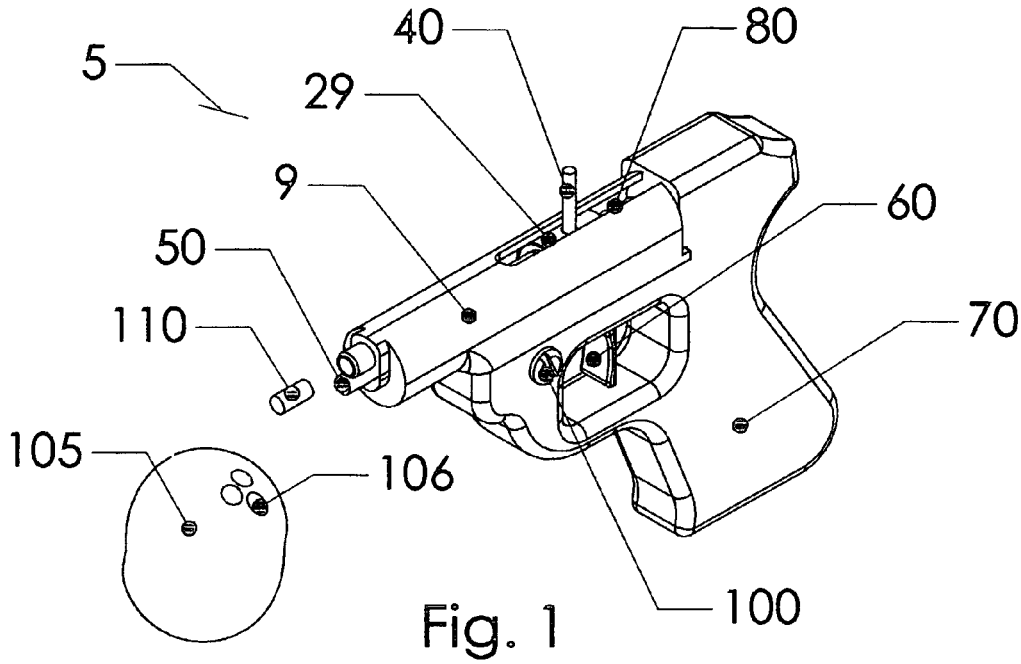
FIG. 1 is an overall perspective view of the assembled Slug Propulsion Device along with a typical Semi-Solid Biodegradable Object (A Potato) in the unloaded state according to the present invention.
Figure 1A:
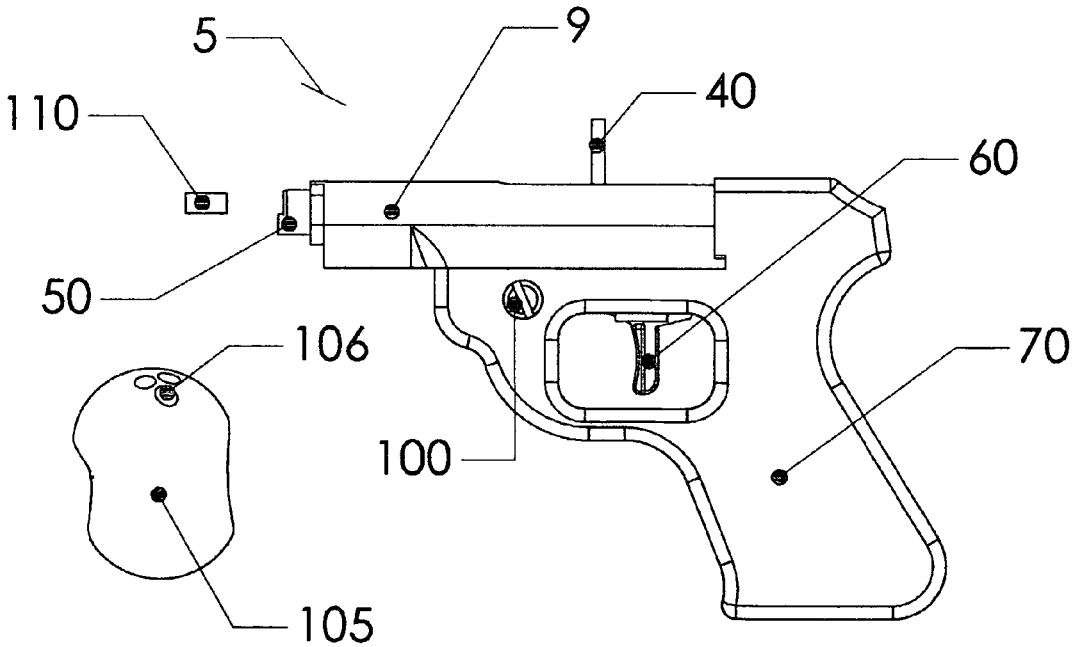
FIG. 1A is an overall side view of the assembled Slug Propulsion Device along with a typical Semi-solid Biodegradable Object (A Potato) in the unloaded state.

Referring now to the drawings, wherein like reference numbers designate identical or corresponding parts throughout each drawing, and more particularly to FIGS. 1 & 1A thereof, there is respectively illustrated a Perspective and Side View of the Slug Propulsion Device 5 including a Receiver 9 which is connected to the Stock 70 by the use of a fastener system 100. Other noted parts, which are described in detail in the other figures, are the Hammer 29, the Hammer Handle 40, the Propulsion Spring 80, the Trigger 60 and the Plunger 50. Along with these parts is also shown a semi-solid biodegradable object 105 (a Potato) with three Missing Cores 106 along with the Projectile Slug 110 shown after it has been cored.

Figure 2:
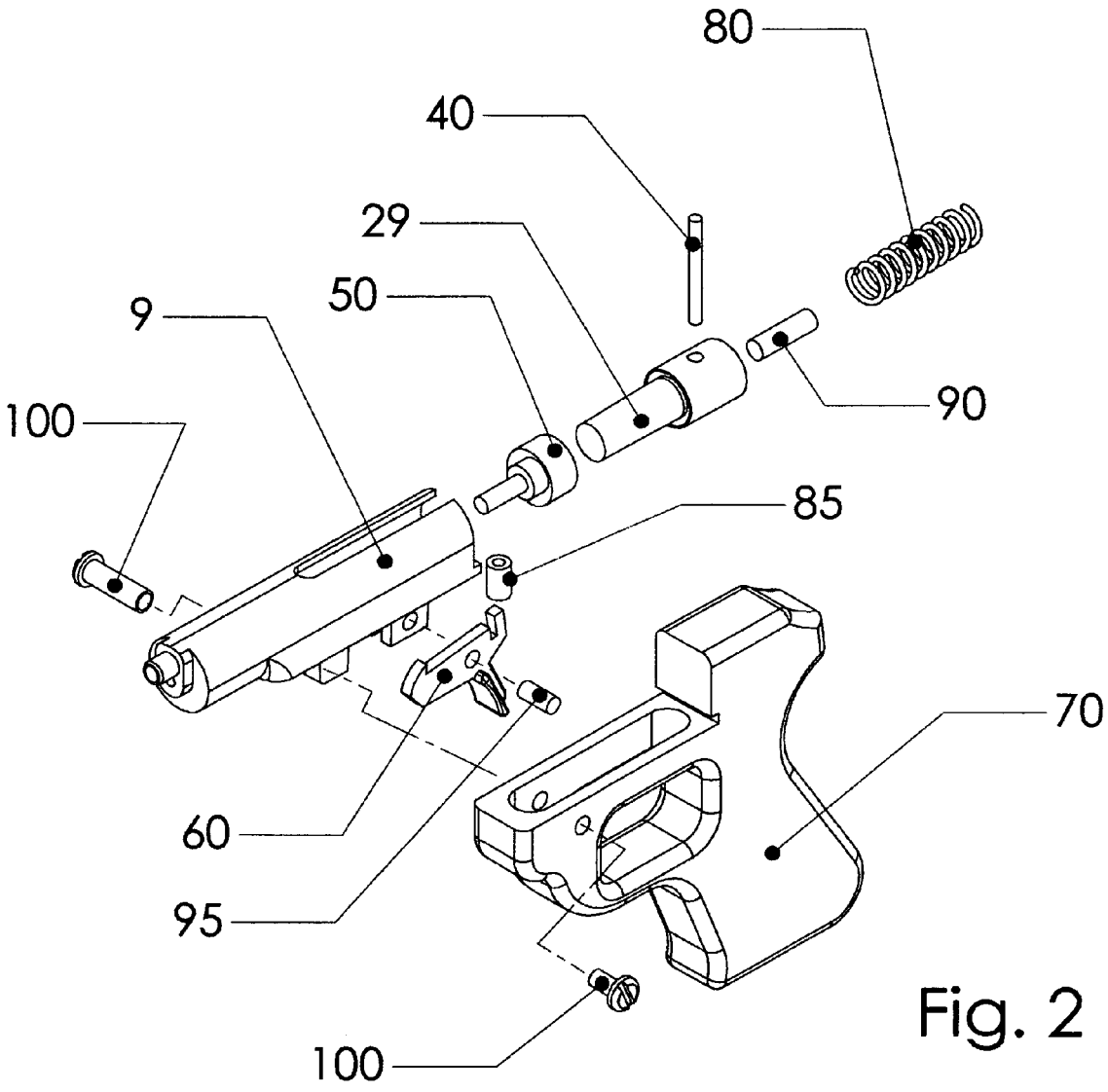
FIG. 2 is an exploded assembly drawing in perspective view of the overall Slug Propulsion Device.

A Perspective view of the exploded assembly of the Slug Propulsion Device FIG. 1, ITEM 5 is shown in FIG. 2. Illustrated here, as they would go together when assembled are all the individual components. The Receiver 9 will first accept the Plunger 50 into its inner cavity followed by the Hammer 29, which is oriented with the Hammer Handle 40 up. The Plunger 50 is inserted all the way into the Receiver 9 until it bottoms out in the end of the cavity. The tip of the Plunger 50 should protrude out the front of the Receiver 9 when it is seated at the end of the cavity. The fit between the Receiver 9 and Plunger 50 is tight as these two parts make up the compression chamber, which propels the slug. The Hammer 29 follows until its front surface hits the rear surface of the Plunger 50. The Hammer 29 is used to hit the Plunger 50 and Compress the trapped air captured inside the compression chamber between the front interior surface of the receiver 9 and the front of the Plunger 50. The Slammer 29 will accept the Hammer Handle 40 if it is not an integral part of the Hammer 29 (Integral Hammer Handle not shown) and the Mass Slug 90 (If installed). The Mass Slug 90 is held in place by the Slug Retainers FIG. 7 ITEM 34 that Protrude from the Cavity down the center of the Hammer 29. The Propulsion Spring 80 sits in the back of the Hammer 29 and up against the Stock 70 when assembled. The rear of the Hammer 29 has an integral feature to capture the Propulsion Spring 80 as it is placed up against the Stock 70. The Trigger 60, having the Trigger Return Spring 85 already mounted is then inserted into the bottom of the Receiver 9 and held in place by the Trigger Pivot Pin 95. The Receiver assembly is then inserted into the Stock 70 and retained by the Fastener 100.

Figure 3:
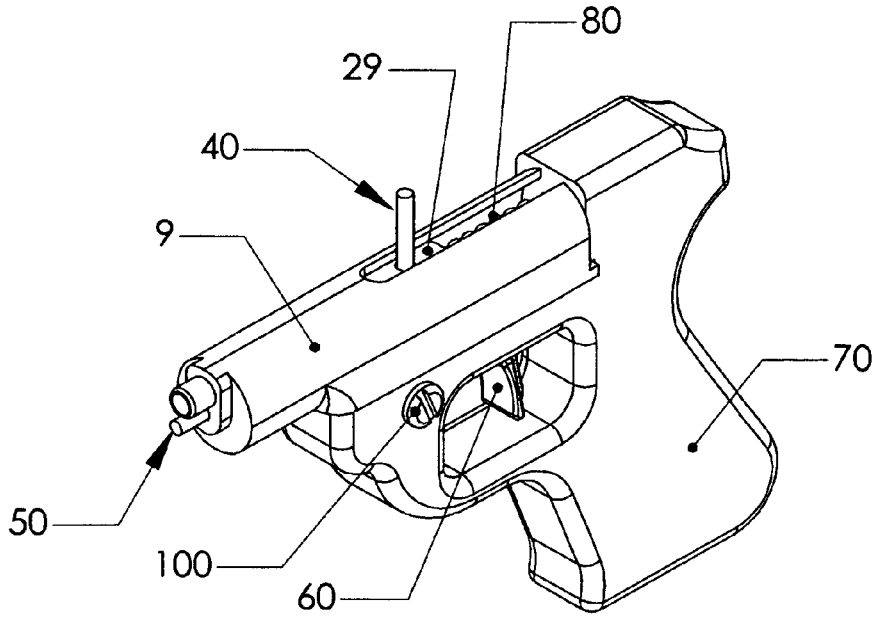
FIG. 3 is an overall perspective view of the assembled Slug Propulsion Device in the unloaded state.

A Perspective view of the Slug Propulsion Device FIG. 1, ITEM 5 unloaded is shown in FIG. 3. Illustrated here much like in FIG. 1 is the assembled Slug Propulsion Device FIG. 1, ITEM 5 that includes the Receiver 9, which is connected to the Stock 70 by the use of a fastener system 100. Other noted parts, which are described in detail in other figures, are the Hammer 29, the Hammer Handle 40, the Propulsion Spring 80, the Trigger 60 and the Plunger 50.

Figure 3A:
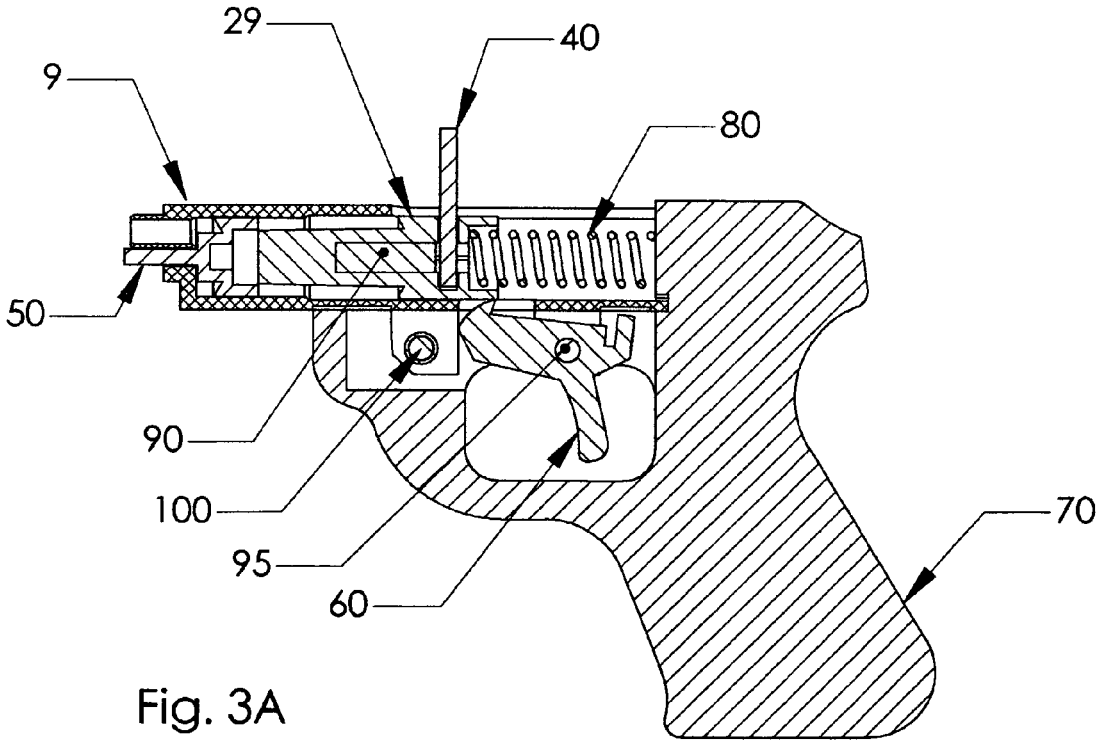
FIG. 3A is a vertical cross section view of the assembled overall Slug Propulsion Device assembly as shown when the device is in the unloaded state.

A vertical cross section view of the Slug Propulsion Device FIG. 1, ITEM 5 is shown in FIG. 3A. Illustrated here as a cut away assembly shown from the side in its unloaded state. Most of the individual components are shown. The Receiver 9 is shown with the Plunger 50 bottomed out inside the compression cavity followed by the Hammer 29. The Hammer 29 is shown with a non-integral Hammer Handle 40 in place along with the Mass Slug 90. The Propulsion Spring 80 is shown uncompressed and located between the backside of the Hammer 29 and up against the Stock 70. The Trigger 60, having the Trigger Return Spring 85 already mounted (but not shown for clarity) is shown in place. The Pivot Pin 95 holds it in place. The Receiver assembly is shown inserted into the Stock 70 and retained by the Fastener 100.

Figure 4:
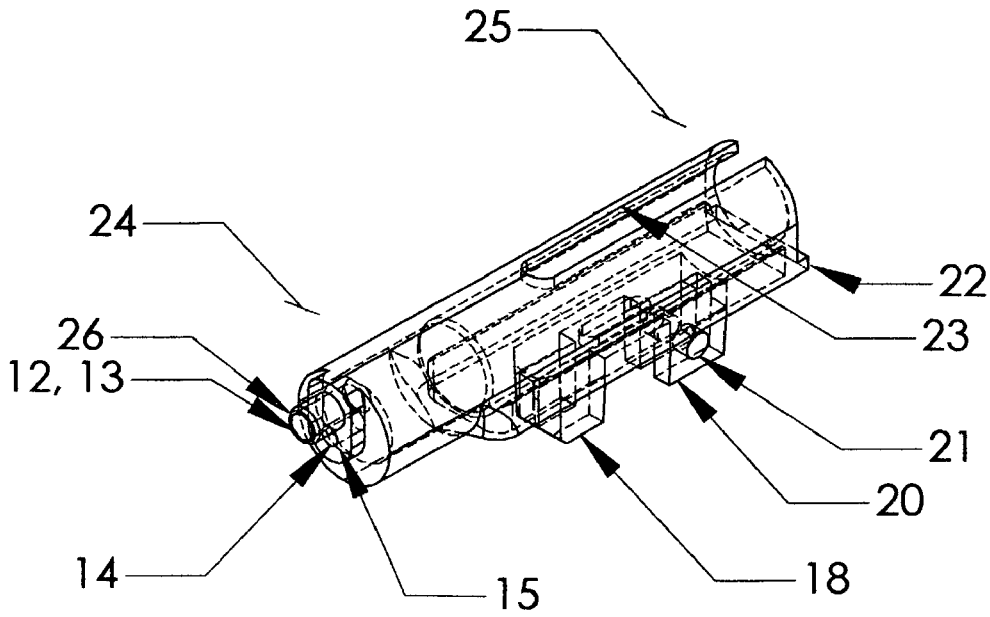
FIG. 4 is a perspective view (with hidden lines shown) of the Receiver as illustrated in assembly drawing FIG. 2.
Figure 5:
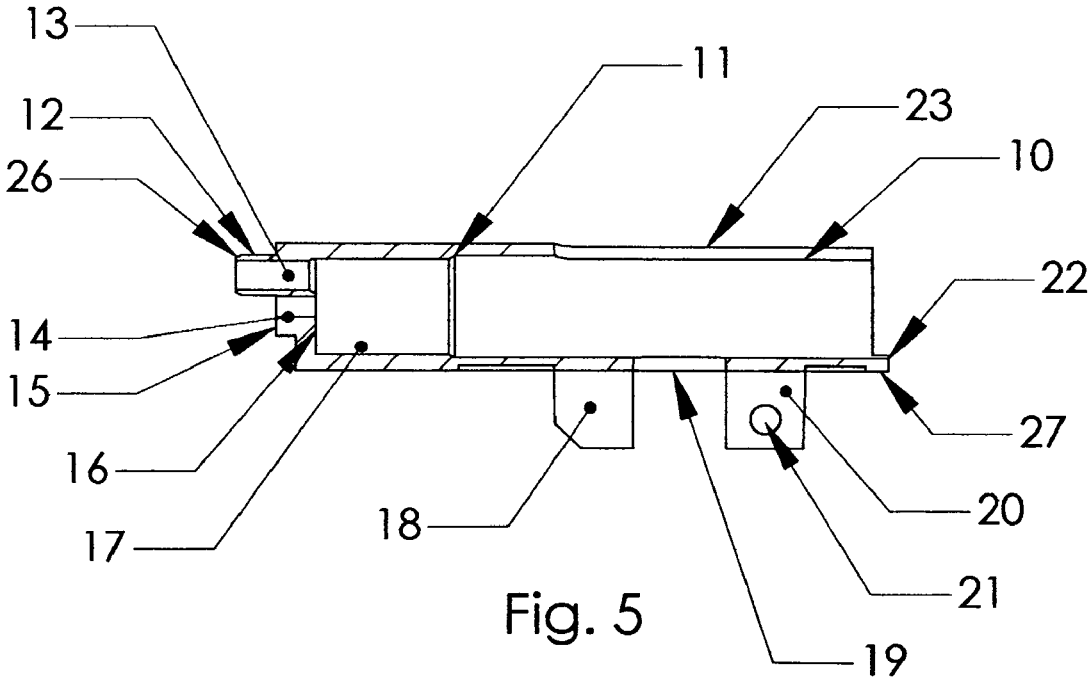
FIG. 5 is a vertical cross section of the Receiver of the device as illustrated in assembly drawing FIG. 2.

A Perspective view (with hidden lines shown) and a vertical cross section view of the Receiver FIG. 1, ITEM 9 is shown in FIGS. 4 & 5. Shown in these views are the overall Receiver Muzzle End 24 and Hammer Receiving End 25. Located on the Muzzle End 24 are the External Projectile Registration Surface 15, the Registration Pin Bore 14, the External Hollow Coring Barrel 12, the Coring Lead-in Feature 26 and the Barrel Bore 13. The External Projectile Registration Surface 15 is a flat surface on the front external face of the Muzzle End 24. It also contains the Registration Pin Bore 14. The Registration Pin Bore 14 is where the Registration Pin FIG. 8, ITEM 51 protrudes out the front of the device. The Registration Pin Bore 14 is concentric with the Compression Cavity 17. Its concentricity and diameter must be tightly controlled so that the fit of the Plunger FIG. 1, ITEM 50 inside the receiver limits the amount of air that can escape as the air trapped inside the Compression Cavity 17 is compressed when the device is fired. The External Hollow Coring Barrel 12 is located on the face of the External Projectile Registration Surface 15 centered left to right and toward the top. This feature can be almost any shape but in this case it is a cylindrical hollow feature that protrudes out from this surface. The length of the External Hollow Coring Barrel 12 along with the External Projectile Registration Surface 15 actually sets the length of the cored projectile. The tip of the External Hollow Coring Barrel 12 has the Barrel Bore 13 and the Coring Lead-in Feature 26. The Barrel Bore 13 is the hollow portion of the External Hollow Coring Barrel 12. This bore extends the length of the External Hollow Coring Barrel 12 and enters the Internal Compression Cavity 17. The Barrel Bore 13 is also where the Projectile Slug FIG. 5, ITEM 110 is wedged in place once cored by the External Hollow Coring Barrel 12 and (when loaded) held in place thru surface friction between the Projectile Slugs FIG. 5, ITEM 110 outer surface and the Barrel Bores 13 inner surface. This effectively seals the air inside the Internal Compression Cavity 17 from the front side of the device. The Coring Lead-in Feature 26 is a chamfered or otherwise sharp edge on the tip of the External Hollow Coring Barrel 12. This feature aids in the surface cutting and coring of the semi-solid biodegradable object as the device is loaded. Inside the front of the Receiver 9 is the Internal Compression Cavity 17 with its integral Plunger Lead-In Feature 11 and Anvil End Surface 16. The Compression Cavity 17 takes up about ¼ the length and is the most precise part of the Receiver 9. As stated above, its diameter must closely match that of the Plunger FIG. 1, ITEM 50 in order to form a good seal with which to propel the projectile. The Compression Chamber Cavity 17 and the Registration Pin Bore 14 must also be concentric in order to easily accept the Plunger FIG. 1, ITEM 50. This concentricity aids in the installation of the Plunger FIG. 1, ITEM 50 so that the angular orientation (with respect to the center of the Compression Chamber Cavity 17) does not matter when assembling the two. The front face of the Compression Cavity 17 is where the Anvil End Surface 16 is located. This feature is what stops the Plunger FIG. 1, ITEM 50 once the device has been fired. It serves more or less as the stopping surface for the internal parts of the device. The Plunger Lead-In Feature 11 is located at the rear end of the Internal Compression Cavity 17. This feature is a chamfered lead-in that opens up to the rest of the Internal Hammer Bore 10, which is slightly larger in diameter then the Compression Cavity 17. Its purpose is to aid in the assembly of the Plunger FIG. 1, ITEM 50. This feature helps to center the Plunger FIG. 1, ITEM 50 in the bore as it slides into the Compression Cavity 17. At the rear of the Receiver 9 is the Hammer Slot 23. It is located on the top surface at the back end of the Hammer Receiving End 25. It protrudes into the Internal Hammer Bore 10 and extends approximately halfway along the entire length of the Receiver 9. This slot is where the Hammer Handle FIG. 1, ITEM 40 will move back and forth as the Slug Propulsion Device is loaded and unloaded. On the bottom side of the Receiver 9 are the Trigger Slot 19, Stock Mounting Boss 18, Trigger Mounting Boss 20, Receiver Mounting Surface 27 and Stock Locking Ledge 22. Both the Stock Mounting Boss 18 and the Trigger Mounting Boss 20 are rectangular in shape and extend down from the bottom surface of the Receiver 9. Both are about half as wide as the Receiver 9 and extend along the length of the Receiver 9 the same. They extend down from the bottom of the Receiver 9 a little farther then they are wide. The Stock Mounting Boss 18 is located about midway along the length of the Receiver 9. This is where the Receiver 9 is screwed or otherwise fastened to the Stock FIG. 1, ITEM 70. It also has a lead in feature on the front corner to aid in assembly. The Trigger Mounting Boss 20 is located toward the rear of the Receiver 9 and is basically the same size as the Stock Mounting Boss 18 but it also has a Trigger Pivot Feature 21 hole in the center. Both pieces have a slot down the center along the length of the Receiver 9 that is about ⅓ the width of the boss. Both the slot and hole are there to mount the Trigger FIG. 1, ITEM 60. The Trigger Slot 19 is located on the bottom side of the Receiver 9 about one-third the distances from the rear of the Receiver 9. It is the same width as the slot and protrudes into the Internal Hammer Bore 10 between the Stock Mounting Boss 18 and the Trigger Mounting Boss 20. The entire bottom side of the Receiver 9 is the Receiver Mounting Surface 27. This surface is no more then a feature that will mate up with the Stock FIG. 1, ITEM 70 in a manor that will cleanly mate the two together. The Stock Locking Ledge 22 is located at the very rear of the Receiver 9 and is a ledge that sticks out past the rear of the receiver. It is about ⅛" long and high and extends along the entire rear surface of the Receiver 9. This feature along with the fastener in the Stock Mounting Boss 18 retain the Receiver to the Stock FIG. 1, ITEM 70

Figure 6:
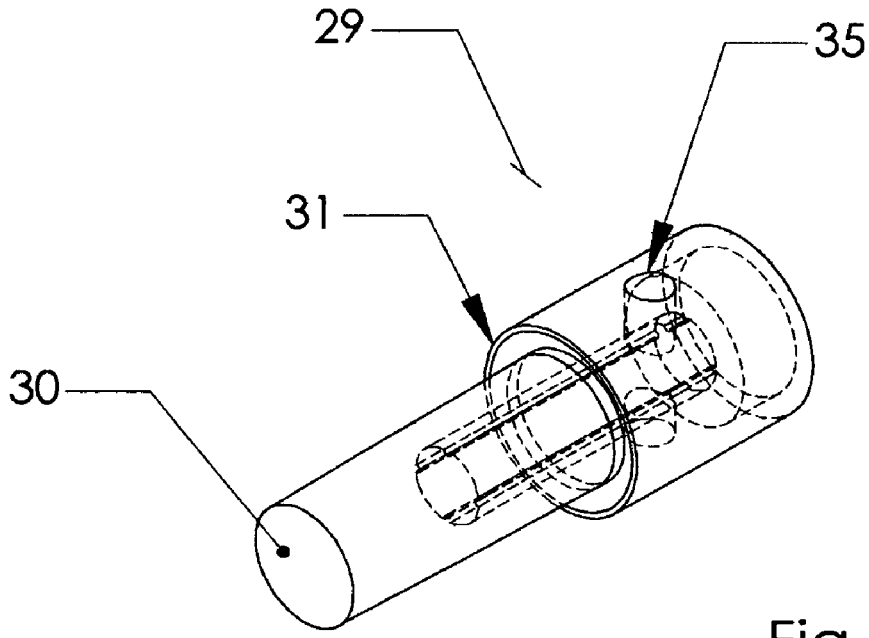
FIG. 6 is a perspective view (with hidden lines shown) of the Hammer as illustrated in assembly drawing FIG. 2.
Figure 7:
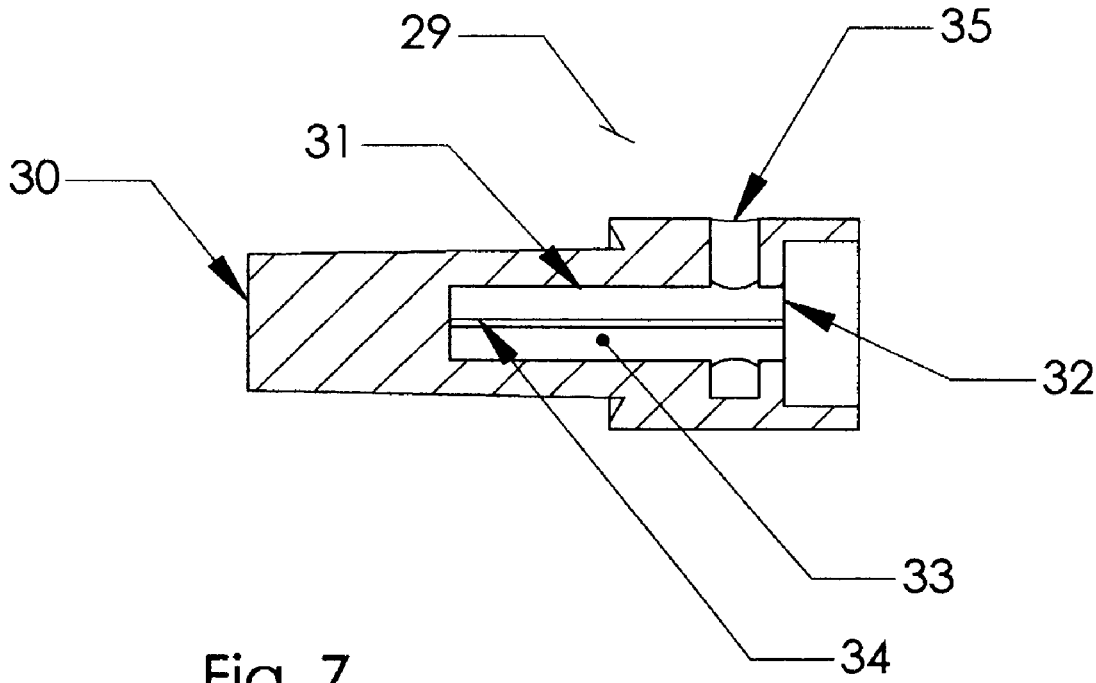
FIG. 7 is a vertical cross section of the Hammer as illustrated in assembly drawing FIG. 2.

A Perspective view (with hidden lines shown) and a vertical cross section view of the Hammer FIG. 1, ITEM 29 is shown in FIGS. 6 & 7. The Hammer 29 is basically made from two cylinders, one larger in diameter then the other with features added to aid in the operation of the shooter. Its overall length is a little less then half the length of the Receiver 9. On one end of the Hammer 29 you will find the Hammer Handle Mounting Feature 35, the Receiver Propulsion Spring Seat 32 and the opening for the Hollow Mass Slug Cavity 33. Shown here is the Hammer Handle Mounting Feature 35 as a hole located about ¼ the distance from the rear end of the Hammer 29 and equal diameter to the Hammer Handle FIG. 1, ITEM 40. The version shown does not have an integrated Hammer Handle FIG. 1, ITEM 40 and is set up to receive a separate Hammer Handle FIG. 1, ITEM 40. The Hammer Handle FIG. 1, ITEM 40 could also be made as an integral part of the Hammer 29 if desired. The Receiver Propulsion Spring Seat 32 is bored into the rear end of the Hammer 29. It is used to seat the Propulsion Spring FIG. 1, ITEM 80. Its depth and diameter are dependent on the type and size of Propulsion Spring FIG. 1, ITEM 80 used. It should be noted that the Receiver Propulsion Spring Seat 32 could easily be a protruding feature rather then a bore and still achieve the same results. The Hollow Mass Slug Cavity 33 is bored into the backside of the Hammer 29. This feature starts at the bottom of the Propulsion Spring Seat 32 and extends into the center of the Hammer 29. The length and diameter of the cavity is dependent on the size of mass that is to be added to its center. The cavity is used to house the Mass Slug FIG. 2, ITEM 90. This slug is used to add additional mass to the Hammer 29 to increase performance. Obviously the larger in diameter and longer the cavity the larger the mass can be added. The inside of the Hollow Mass Slug Cavity 33 has four protrusions added to the bore wall equally spaced around the diameter. These protrusions, called Slug Retainers 34 are used to retain the Mass Slug FIG. 2, ITEM 90 inside the Mass Slug Cavity 33 so that the additional mass is held tightly inside the Hammer 29. They extend the entire length of the bore. It should also be noted that the Mass Slug FIG. 2, ITEM 90 could also easily be molded as part of the Hammer 29 and the Hollow Mass Slug Cavity 33 could be eliminated and still result in the same basic principle. The Hammer Handle Mounting Feature 35 is also used to retain the Mass Slug FIG. 2, ITEM 90 as the Hammer Handle FIG. 1, ITEM 40 is inserted. The handle slides in behind the additional mass and helps to lock it in place. Located midway along the length of the Hammer 29 is the Trigger Release Flange 31. This flange is a grove going around the entire external circumference of the Hammer 29. The flange is located at the transition point where the two different outside diameters of the Hammer 29 meet and undercuts the larger of the two diameters so that a simple "V" ledge is formed for the Trigger FIG. 1, ITEM 60 grabs the Hammer 29 when the slug propulsion device is cocked. The Trigger Release Flanges 31 "V" geometry mirrors that of the locking feature on the Trigger FIG. 1, ITEM 60 so that the two work together to hold the Hammer 29 in the cocked position. The front end of the Hammer 29 is where the Hammer Anvil Surface 30 is located. This is a flat solid surface that strikes the Plunger FIG. 2, ITEM 50 when the Slug Propulsion Device is fired.

Figure 8:
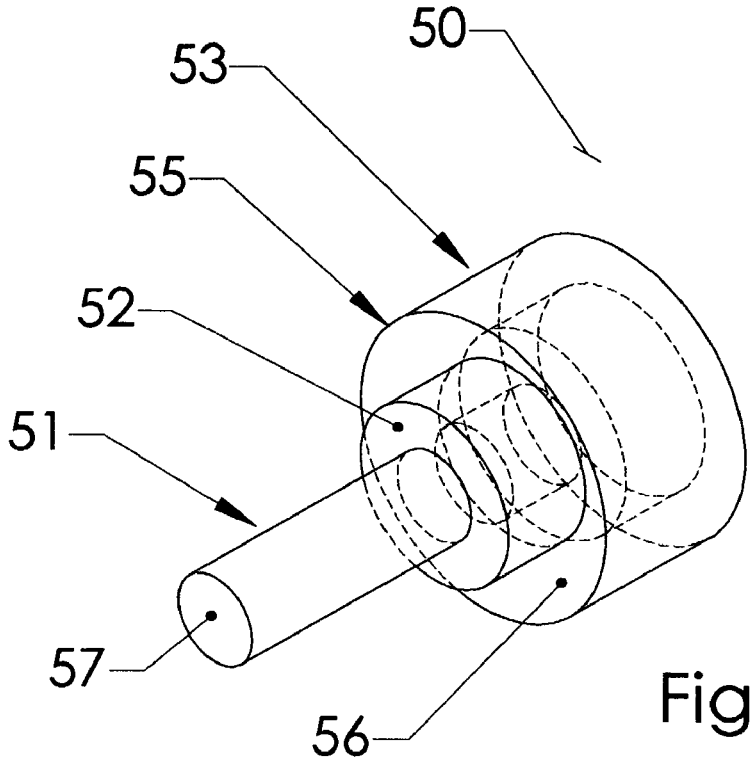
FIG. 8 is a perspective view of the Plunger (with hidden lines shown) as illustrated in assembly drawing FIG. 2.
Figure 9:
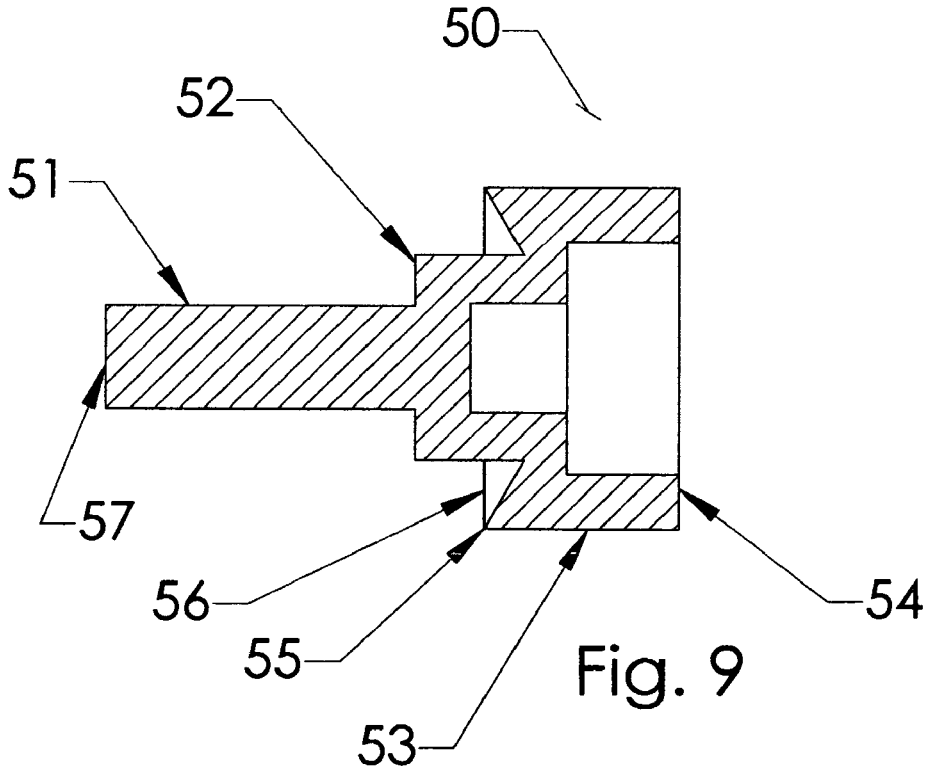
FIG. 9 is a vertical cross section of the Plunger as illustrated in assembly drawing FIG. 2.

A Perspective view (with bidden lines shown) and a vertical cross section view of the Plunger FIG. 1, ITEM 50 is shown in FIGS. 8 & 9. The Plunger 50 is comprised of three cylindrical features that step up in diameter as you go from front to rear. Its overall length is about half that of the Hammer 29. The front end of the Plunger 50 comprises the Registration Pin 51 and the Registration Pin Contact Surface 57. The Registration Pin 51 is the pin that sticks out the front of the Receiver and helps set the Compression Chamber FIG. 5, ITEM 17. It is the smallest diameter and is about half the length of the entire Plunger 50. The diameter of the Registration Pin 51 must closely match that of the Registration Pin Bore FIG. 5, ITEM 14 in order to maintain a seal in the Compression Chamber FIG. 5, ITEM 17. On the front end of the Registration Pin 51 is the Registration Pin Contact Surface 57. This flat surface is what actually comes in contact with the Semi-Solid Biodegradable object as the device is being loaded. The middle portion of the Plunger 50 contains the Stop Boss Surface 52 and the Contamination Pocket 56. The Stop Boss Surface 52 is about twice the diameter of the Registration Pin 51 and has a flat surface on its face. This surface is used to stop the Plunger 50 once the Slug Propulsion Device has been fired. It will bottom out on the Anvil End Surface FIG. 5, ITEM 16 inside the receiver FIG. 1, ITEM 9. The Contamination Pocket 56 is located just behind the Stop Boss Surface 52 and is an area where any debris from the semi-solid biodegradable object that may get inside the compression chamber FIG. 5, ITEM 17 can collect. The contamination needs to be collected so it does not interfere with the operations of the Slug Propulsion Device. The pocket is a "V" groove that goes around the entire diameter of the Plunger 50. The leading edge of the pocket also serves as the leading edge for the Plunger seal lip 55. This lip is the first part of the Plunger that actually seals the Compression Chamber FIG. 5, ITEM 17. It also leads into the Plunger Piston Surface 53 and on to the rear of the Plunger 50. The Plunger Piston Surface 53 is the largest diameter of the Plunger 50. Its Outside diameter must closely match that of the Compression Chamber FIG. 5, ITEM 17 in order to maintain pressure and expel the projectile. It also must be concentric with the Registration Pin 51. The length of the Plunger Piston Surface 53 is about ¾ the length of the Registration Pin 51. The back surface of the Plunger 50 is called the Hammer Anvil Surface 54. This surface is where the Hammer FIG. 1, ITEM 29 strikes the Plunger 50 when the device is fired and transfers its energy in order to compress the trapped air and fire the projectile. The center of the Plunger is hollowed out in order to maintain a consistent outside diameter on the Plunger Piston Surface 53.

Figure 10:
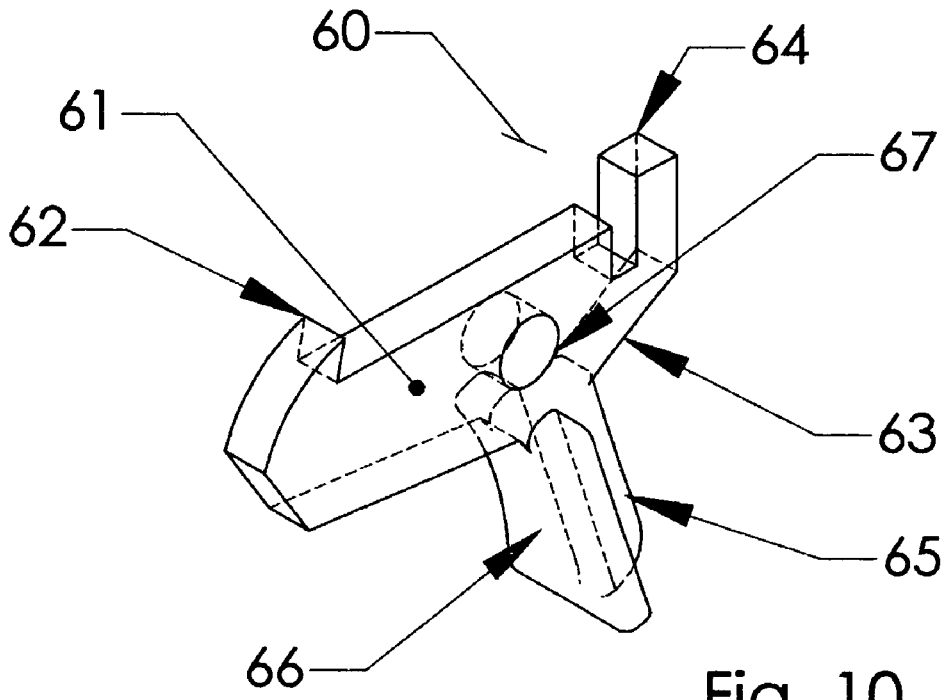
FIG. 10 is a perspective view of the Trigger (with hidden lines shown) as illustrated in assembly drawing FIG. 2.
Figure 11:
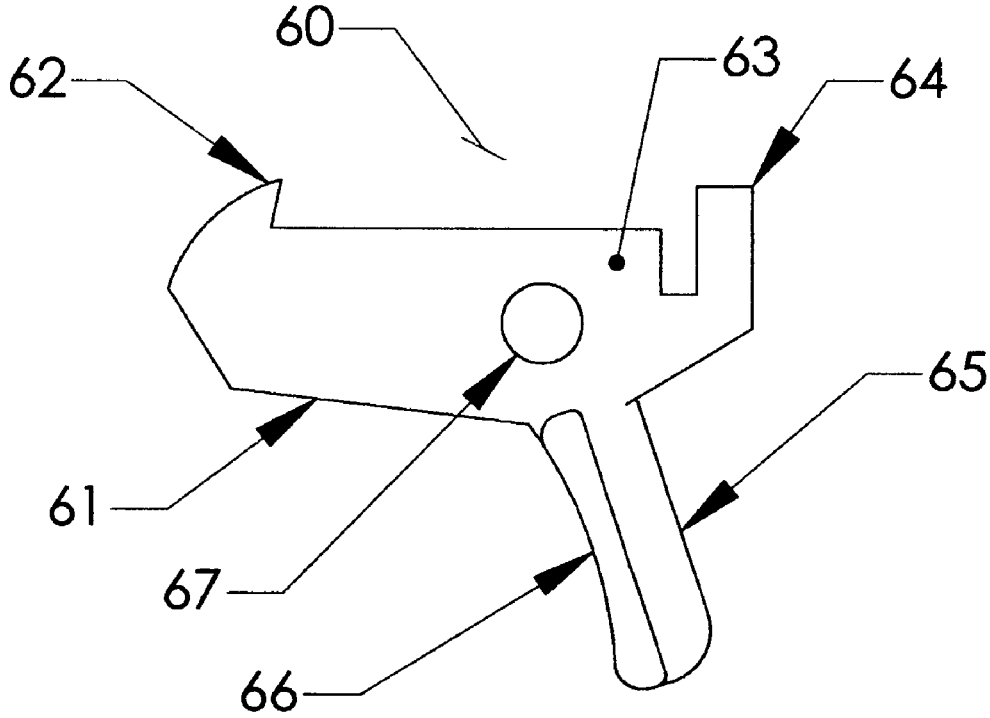
FIG. 11 is a side view of the Trigger as illustrated in assembly drawing FIG. 2.

A Perspective view (with hidden lines shown) and a Side view of the Trigger FIG. 1, ITEM 60 is shown in FIGS. 10 & 11. The Trigger 60 has four main areas to it. The Catch Lever Arm 61, the Trigger Return Lever Arm 63, the Finger Lever Arm 65 and the Pivot Feature 67. Each arm goes out in different directions toward the part of the device which it interfaces with. The actual geometry of the Trigger 60 is not so important as long as it mates up with each respective part. The Catch Lever Arm 61 extends out the front of the Trigger 60 and has the Hammer Trigger Catch 62 on its end. This feature is used to hold the Hammer FIG. 1, ITEM 29 in place when the unit is loaded. The Hammer Trigger Catch 62 is designed specifically to interface with the Trigger Release Flange FIG. 7, ITEM 31 on the Hammer FIG. 1, ITEM 29. The Trigger Return Lever Arm 63 extends out the rear of the Trigger 60 and features the Trigger Return Spring Mount 64. The Trigger Return Spring Mount 64 is used to mount and hold in place Trigger Return Spring FIG. 2, ITEM 85. This feature is what returns the Trigger 60 to its original position once it has been depressed in order to fire the device. The Finger Lever Arm 65 extends down the bottom of the Trigger 60. This is where the Finger Pressure Surface 66 is located and is used to fire the projectile when it is depressed. This feature should be sculpted in order to provide a comfortable surface on which the finger can rest while it is firing the device. The Pivot Feature 67 is located in the center of the Trigger 60. In this case is a hole for a pivot pin FIG. 2, ITEM 95 but could also easily be adapted to be some sort of boss to act as the pivot surface. The location of the Pivot Feature 67 and the overall size of the Trigger 60 will depend on the overall geometry of the shooter. The overall width of the Trigger 60 must be thin enough to easily fit in the slot down the middle of the Trigger Mounting Boss FIG. 5, ITEM 20.

Figure 12:
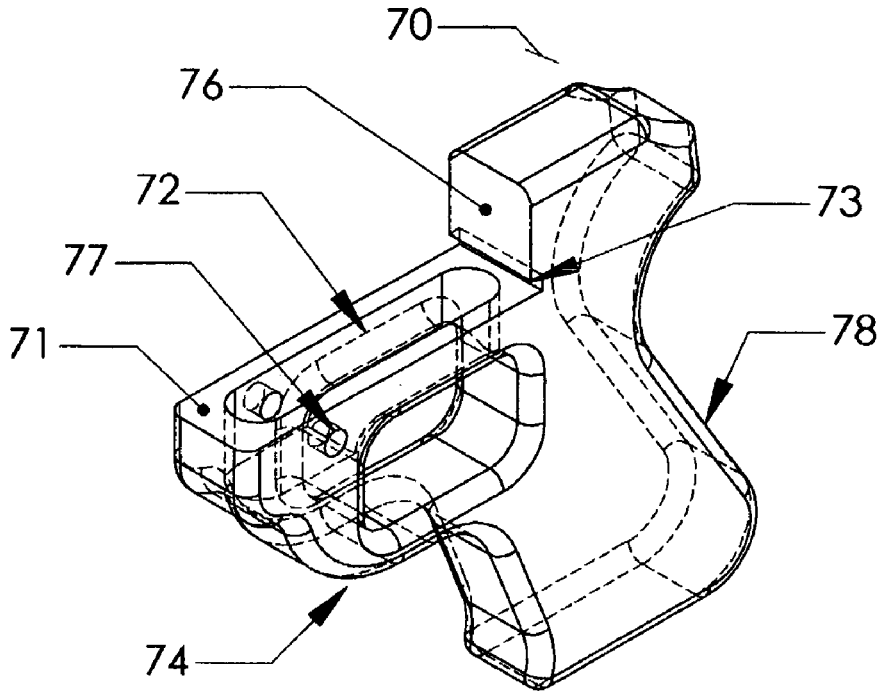
FIG. 12 is a perspective view of the Stock (with hidden lines shown) as illustrated in assembly drawing FIG. 2.
Figure 13:
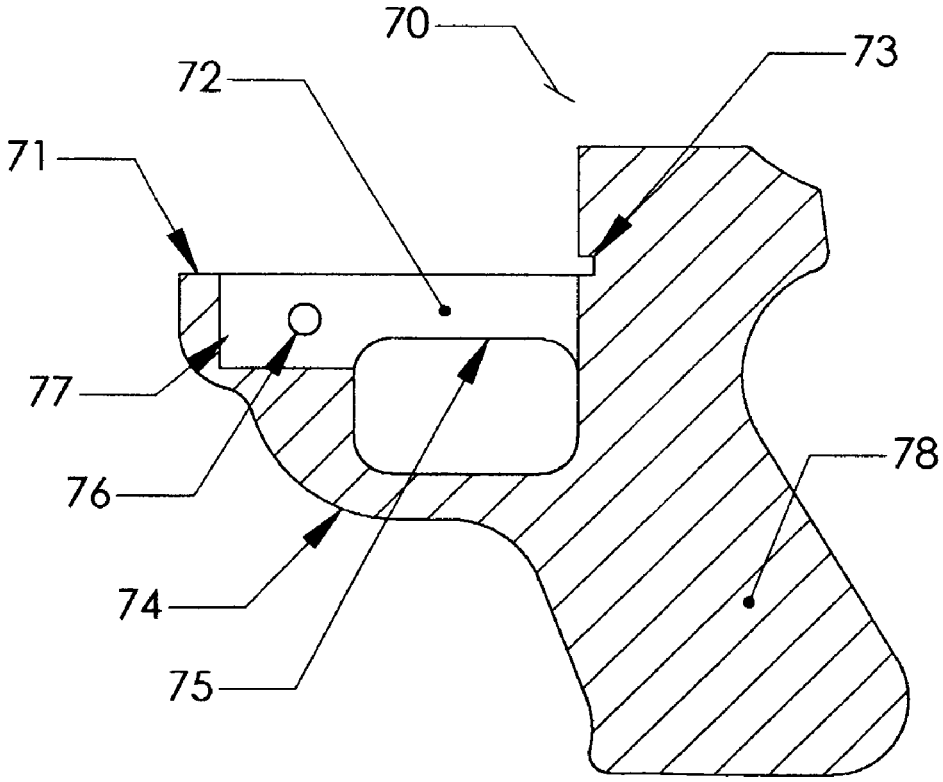
FIG. 13 is a vertical cross section of the Stock as illustrated in assembly drawing FIG. 2.

A Perspective view (with hidden lines shown) and a vertical cross section view of the Stock FIG. 1, ITEM 70 is shown in FIGS. 12 & 13. The Stock 70 is designed and sculpted so that it not only mates with the Receiver FIG. 1, ITEM 9 but so that it also helps to identify the styling of the overall Slug Propulsion Device. In order to do this the Stock 70 needs to have a Receiver Mounting Surface 71, a Trigger Slot 75, a Stock Mounting Boss Slot 72, a Stock Locking Ledge Slot 73, a Receiver Mount Fastener Area 77 and a Receiver Propulsion Spring Seat Surface 76. The Stock should also have a Trigger Guard 74 and a Grip 78 in order to give it some sore of style. The actual styling of the Stock 70 can change as required to fit the overall design intended. The above features need to be included though in order to properly interface with the rest of the mechanism.

A description of the general operation of the Slug Propulsion Device can best be described while looking at FIG. 1. Once the user selects the type of semi-solid biodegradable object 105 they want to fire they need to cock the Slug Propulsion Device. This is done by pulling back on the Hammer Handle 40 until you hear the Trigger 60 click when it engages the Hammer 29. This action compresses the Propulsion Spring 80. The user then will jam the tip of the Receiver 9 into the semi-solid biodegradable object 105 and break off a Projectile Slug 110 from the semi-solid biodegradable object 105. The shooter needs to be pivoted to one side or the other in order to break off the slug. At this point the Projectile Slug 110 will be stuck inside the tip of the Receiver 9. The Plunger 50 will have been moved back inside the nose of the Receiver 9 which will create a small air chamber inside the nose of the Receiver 9. The Projectile Slug 110 will have sealed off and trapped a small volume of air inside the device. The Slug Propulsion Device is now loaded and ready to fire. The user then aims the Slug Propulsion Device in the direction desired and pulls the Trigger 60. At this point the Hammer 29 is released and the Propulsion Spring 80 will drive it forward as fast as it can. Once the Hammer 29 has traveled down the length of the Receiver 9 it will strike the backside of the Plunger 50. The energy stored in the moving mass of the Hammer 29 will then be transferred to the Plunger 50 as the Hammer 29 strikes it. The Plunger 50 will start to move the same direction as the Hammer 29 and compress the air that is trapped inside the Receiver 9 between the Plunger 50 and the Projectile Slug 110. Once enough pressure is built up inside the compression chamber the Projectile Slug 110 will break free from the tip of the Receiver 9 and be expelled out of the Slug Propulsion Device in the direction the user aimed.

Obviously, many portions of the present invention can be modified or improvised upon given the documentation presented herein. It is therefore understood that within the scope of the appended claims, the invention documented within can be implemented and packaged in ways other then those specifically described herein.

What is claimed to be new and desired to be secured by Letters Patent of the United States is:

1. A device for propelling a small slug that has been cored from a semi-solid biodegradable object comprising:

a handle made from wood or plastic, the handle comprising:

a receiver having a barrel end and a hammer receiving end with an integral compression cavity therein, the receiver having an external hollow coring bore at the barrel end with a coring lead in feature for coring and frictionally holding a slug of a semi-solid biodegradable object, the receiver having an external registration surface with a registration pin bore, a plunger having a registration pin disposed within the registration pin bore and a sealing surface with a leading sealing lip, the plunger having a stopping surface and an area to collect possible contamination in front of the sealing lip, wherein movement of the registration pin inside the registration pin bore compresses the plunger, thereby trapping air inside the compression cavity;

a hammer assembly having a restoring handle, a hammer spring to store energy once compressed and to propel the hammer assembly once released, a trigger with a hammer catch for engaging the hammer assembly, holding it back while it compresses the hammer spring and for releasing the hammer assembly once the device is fired, the trigger being reset by a trigger return spring and further being held to the device by a fastener about which the trigger rotates;

wherein actuation of the trigger causes the hammer assembly to strike the plunger, compressing the air trapped inside the compression cavity until the internal pressure overcomes the friction force holding the slug inside the hollow coring bore, thereby propelling the slug out of the device.

2. The device according to claim 1, the trigger further including a hammer trigger catch, wherein translation of the restoring handle toward the hammer receiving end compresses the hammer spring and brings the hammer assembly into engagement with the hammer trigger catch, placing the device in a cocked position.

3. The device according to claim 2, wherein the slug is broken off from a larger piece and is held in the external hollow coring bore by the friction generated by the internal surface of the hollow coring bore and the external surface of the slug.

4. The device according to claim 2, wherein the slug can be fired using one hand by aiming the device and pulling the trigger.

5. The device according to claim 1, wherein the registration pin bore is axially aligned with the compression cavity and the plunger, and wherein movement of the registration pin into the registration pin bore increases the volume of air contained in the compression cavity.

6. The device according to claim 5, wherein the registration pin extends out from the tip of the plunger.

7. The device according to claim 5, wherein the registration pin extends out of the receiver when the device is in an unloaded position.

8. The device according to claim 5, wherein the registration pin is driven into the registration pin bore by the surface of the semi-solid biodegradable object when the device is loaded.

9. The device according to claim 5, wherein the registration pin can be manually pushed into the receiver pin bore before the slug is loaded.

10. The device according to claim 5, wherein the registration pin further comprises a registration pin contact surface, wherein when the registration pin contact surface lines up with the external registration surface, the external registration surface acts as a stop that limits the length of the slug inside the hollow coring bore.

11. The device according to claim 5, wherein the compression cavity is ready to fire once the tip of the registration pin reaches the front surface of the receiver.

12. The device according to claim 5, wherein the area to collect possible contamination comprises a pocket in front of the sealing lip and behind the registration pin to collect contamination that might enter the compression cavity during normal use of the device.

13. The device according to claim 1, wherein when the plunger is impacted by the hammer assembly, the air trapped in front of the plunger is compressed in order to propel the slug.

14. The device according to claim 13, wherein the mass of the plunger and the stored energy from the hammer spring provide the only energy by which the trapped air is compressed.

15. The device according to claim 13, wherein the energy from the hammer spring and the hammer assembly is transferred to the plunger when the hammer reaches the end of its stroke in the receiver.

16. The device according to claim 13, wherein the air in front of the plunger is sealed in the compression chamber between the slug and the plunger.

17. A method for operating the device of claim 2, comprising of the following steps:

holding on to the handle of the device;

pulling back on the restoring handle of the hammer assembly, thereby compressing the hammer spring and sliding the hammer assembly towards the hammer receiving end of the receiver;

locking the hammer assembly in the cocked position by engaging the hammer trigger catch with the hammer assembly;

pushing the registration pin into the registration pin bore either manually or through contact with the semi-solid biodegradable object, pushing the hollow coring bore into the surface of the semi-solid biodegradable object thereby coring the slug and wedging it inside the hollow coring bore via surface friction and further sealing air in the compression cavity;

aiming the device;

depressing the trigger to release the hammer assembly from the hammer trigger catch to release the energy stored in the hammer spring, thus accelerating the hammer assembly until it strikes the plunger which subsequently compresses the air trapped inside the compression cavity upon reaching a critical pressure inside the compression cavity, the surface friction between the slug and the coring bore will be overcome, and the slug will break free from the coring bore and be propelled away from the device.

* * * * *